United States Patent [19]

Galvin et al.

[11] Patent Number: 4,882,591

[45] Date of Patent: Nov. 21, 1989

[54] BASE LOADED ANTENNA

[75] Inventors: Richard W. Galvin, Riverside, Calif.; James W. Wilson, Las Vegas, Nev.

[73] Assignee: Wilson Antenna Inc., Henderson, Nev.

[21] Appl. No.: 252,752

[22] Filed: Oct. 3, 1988

[51] Int. Cl.[4] ..... H01Q 1/12; H01Q 1/32

[52] U.S. Cl. ..... 343/715; 343/749; 343/888; 343/906

[58] Field of Search ..... 343/713, 715, 749, 888, 343/900, 906; 336/207, 208; 439/551, 559, 916; 174/152 A, 153 A, 138 A

[56] References Cited

U.S. PATENT DOCUMENTS

| | | | |
|---|---|---|---|
| 2,406,961 | 9/1946 | Nichol | 336/207 |
| 2,425,304 | 8/1947 | Combs | 336/208 |
| 3,145,384 | 8/1964 | Nuttle | 343/749 |
| 3,249,945 | 5/1966 | Lewis | 343/749 |
| 3,453,618 | 7/1969 | Ukmar et al. | 343/749 |
| 3,561,111 | 2/1971 | Beck et al. | 336/207 |
| 4,086,596 | 4/1978 | Gauss et al. | 343/715 |
| 4,161,710 | 7/1979 | Kakurai | 343/749 |
| 4,170,777 | 10/1979 | Liautaud | 343/749 |

FOREIGN PATENT DOCUMENTS 2616968 10/1977 Fed. Rep. of Germany ..... 343/715

*Primary Examiner*—Rolf Hille
*Assistant Examiner*—Michael C. Wimer
*Attorney, Agent, or Firm*—Freilich, Hornbaker, Rosen & Fernandez

[57] ABSTRACT

A base loaded antenna is provided, which securely holds the inductive loading coil of the antenna while minimizing capacitive coupling of adjacent coil turns. A coil support has fins with grooves that hold the coil, so most of the space between adjacent coil turns contains only air. A cover surrounds the coil, and the coil support is loaded in tension while the cover is loaded in corresponding compression. A base on which the coil support and cover are mounted, is held to a vehicle sheet metal body by a star plate that lies on the underside of the sheet metal. The star plate has bent-up peripheral portions that "dig" into the sheet metal to make an electrical ground connection therewith, and a flat middle for making electrical and mechanical connections to outer coaxial conductors.

5 Claims, 5 Drawing Sheets

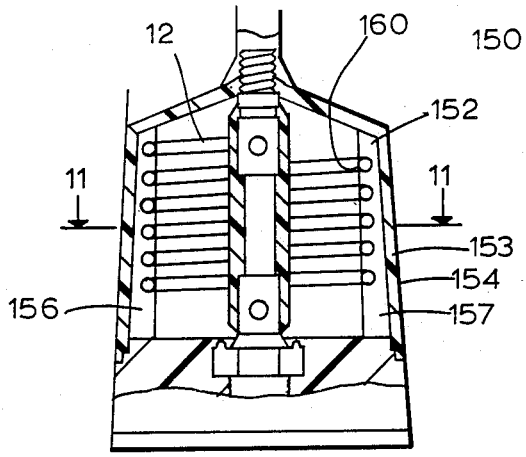
FIG. 10
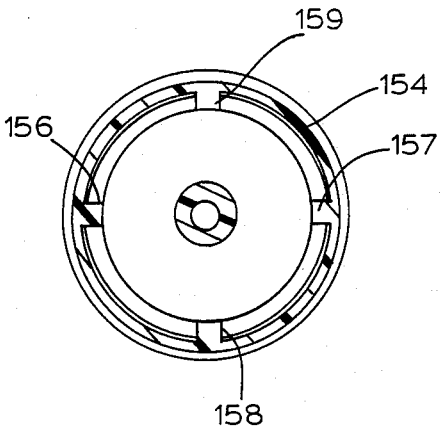
FIG. 11
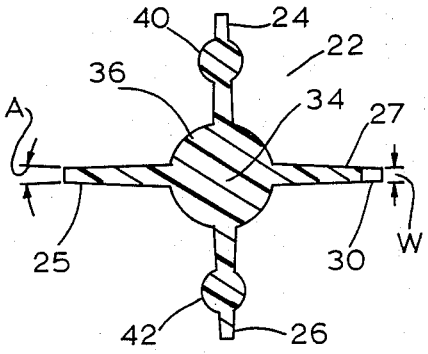
FIG. 8
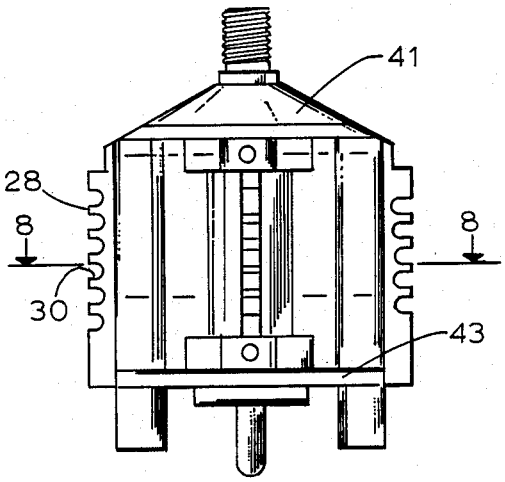
FIG. 7
FIG. 9
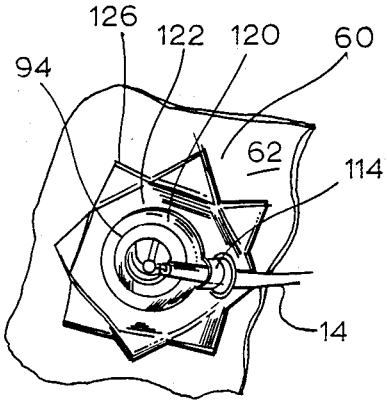

BASE LOADED ANTENNA

FIELD OF THE INVENTION

The present invention relates to a vehicular communication antenna which has been designed as a citizens band radio antenna, but also has higher power capacity for amateur radio application. More specifically, the present invention involves the inductive coil for a base loaded antenna, its support, enclosure and mounting structures.

BACKGROUND OF THE INVENTION

In citizens band radio applications the ideal antenna is a full quarter wavelength vertical radiator (about 8 ½ feet long at about 27 MHz). However, most of these antennas are carried on automobiles and it would be impractical to carry an antenna over eight feet in length. This has been recognized in the prior art and as a result a shortened so-called "loaded" antenna has been used. The loading apparatus is placed at a base which is mounted on the vehicle, and the base supports a shortened antenna commonly referred to as an "antenna whip".

Shortening an antenna to a length of less than a quarter wavelength transforms the radiator from an almost purely resistive device that closely matches its associated transmission line to a device having resistance and capacitive reactance. The simplest means of offsetting this added capacitive reactance is to place a cancelling inductive reactance into the transmission line radiator circuit. This use of a coil, or inductive reactance, is commonly known in the art as "loading". The coil of wire is wound on a support and placed along the shortened radiator, often at the base which is mounted on the vehicle.

Prior art designs for citizen band antennas have lacked efficiency due largely to losses incurred in the loading coil. It is well understood that inductive elements are subjected to capacitive losses such as from the capacitance effects between turns of the coil. What is perhaps less well understood is the nature and cause of so-called dielectric losses, which occur within the insulating materials used to support coils. Such dielectric losses manifest themselves primarily as heat, which limits the power-handling capacity of the antenna as well as reducing efficiency.

Commercial antennas used for citizen band application have generally not been used also for amateur radio. A primary reason is that the coils of most currently available citizen band antennas are designed for low power use (e.g., 5 watts), and would burn out if used at the power levels that are common in amateur radio (e.g., up to 1000 watts). However, there is an obvious advantage to being able to use the same antenna for both applications for those who are involved in both types of radio communications.

SUMMARY OF THE INVENTION

In accordance with one embodiment of the present invention, a base loaded antenna is provided which is of high efficiency and ruggedness, and can operate at high power levels. The antenna includes a base loading coil mounted on a coil support whose lower end can be coupled through a mount assembly to a vehicle and whose upper end is coupled to an antenna mast assembly. The coil support is a plastic molded member which forms a limited number of fins that engage locations along the coil turns to mechanically support the coil while minimizing the amount of dielectric material between adjacent turns to thereby minimize inter-turn capacitance. The coil support has a minimum of dielectric material within the coil to minimize heating and heating losses.

The mount assembly can include portions that lie on opposite sides of the sheet metal of a vehicle, and that are connected through a hole in the sheet metal. The lower portion includes a star plate with a flat middle and with several bent-up edge portions. As the upper and lower mount assembly portions are threadably tightened, the bent-up edge portions of the star plate "dig" into the underside of the vehicle sheet metal to provide a spring-loaded washer that also provides low resistance electrical connection to the electrical ground of the vehicle sheet metal. The spring-loading also allows moderate variation in mounting surface sheet metal thickness. The flat middle portion of the star plate provides a surface that mechanically and electrically holds to a coaxial cable holder that supports a coaxial cable that connects a transmitter in the vehicle to the antenna.

The coil is surrounded by a shell or cover which, like the coil support, extends between the mount assembly and an antenna mast assembly. A threaded member on the antenna mast assembly can be turned to pull up the coil support to maintain it in tension, to thereby strengthen the coil support against sideward deflection. The threaded member is supported by the cover, which is maintained in compression, which the large diameter cover can easily support. The combined tension and compression loadings of the coil support and cover result in increased rigidity and strength, to avoid damage from large sideward loading, as when the antenna whip is deflected sharply to one side when a vehicle passes through a low tunnel or other overhead barrier.

The novel features of the invention are set forth with particularity in the appended claims. The invention will be best understood from the following description when read in conjunction with the accompanying drawings.

BRIEF DESCRIPTION OF THE DRAWINGS

FIG. 7 is a side elevation view of the coil support of the antenna of FIG. 4.

FIG. 8 is a view taken on the line 8—8 of FIG. 7.

FIG. 9 is a bottom perspective view of the antenna of FIG. 4.

FIG. 10 is a partial sectional view of an antenna constructed in accordance with another embodiment of the invention.

FIG. 11 is a view taken on the line 11—11 of FIG. 10.

DESCRIPTION OF THE PREFERRED EMBODIMENTS

Figure 1:
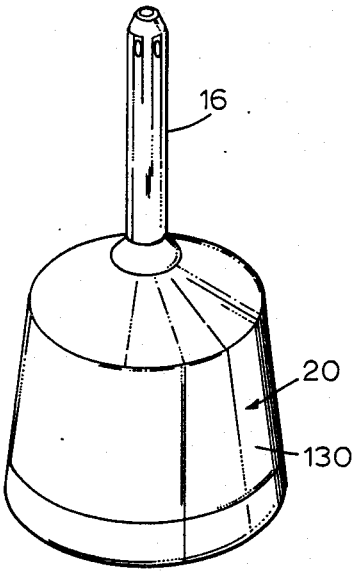
FIG. 1 is a perspective view of an antenna constructed in accordance with one embodiment of the present invention.
Figure 2:
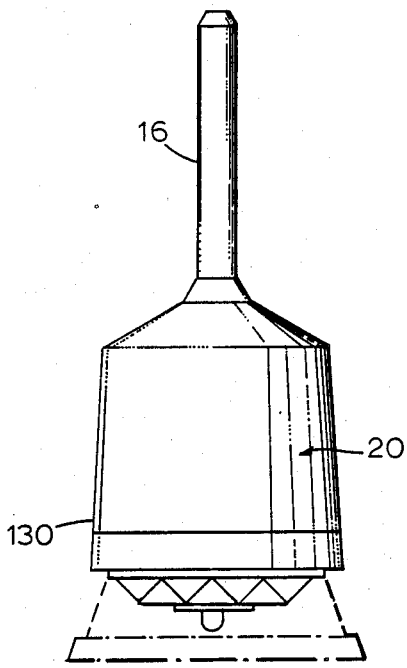
FIG. 2 is an elevation view of the antenna of FIG. 1, and showing an optional vehicle truck mount in phantom lines.
Figure 3:
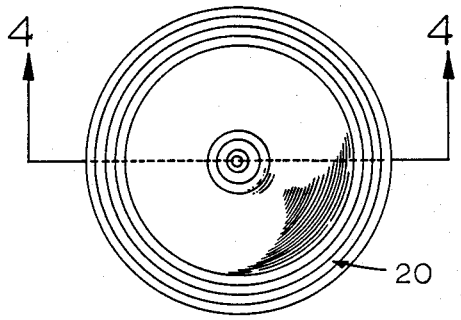
FIG. 3 is a plan view of the antenna of FIG. 1.
Figure 4:
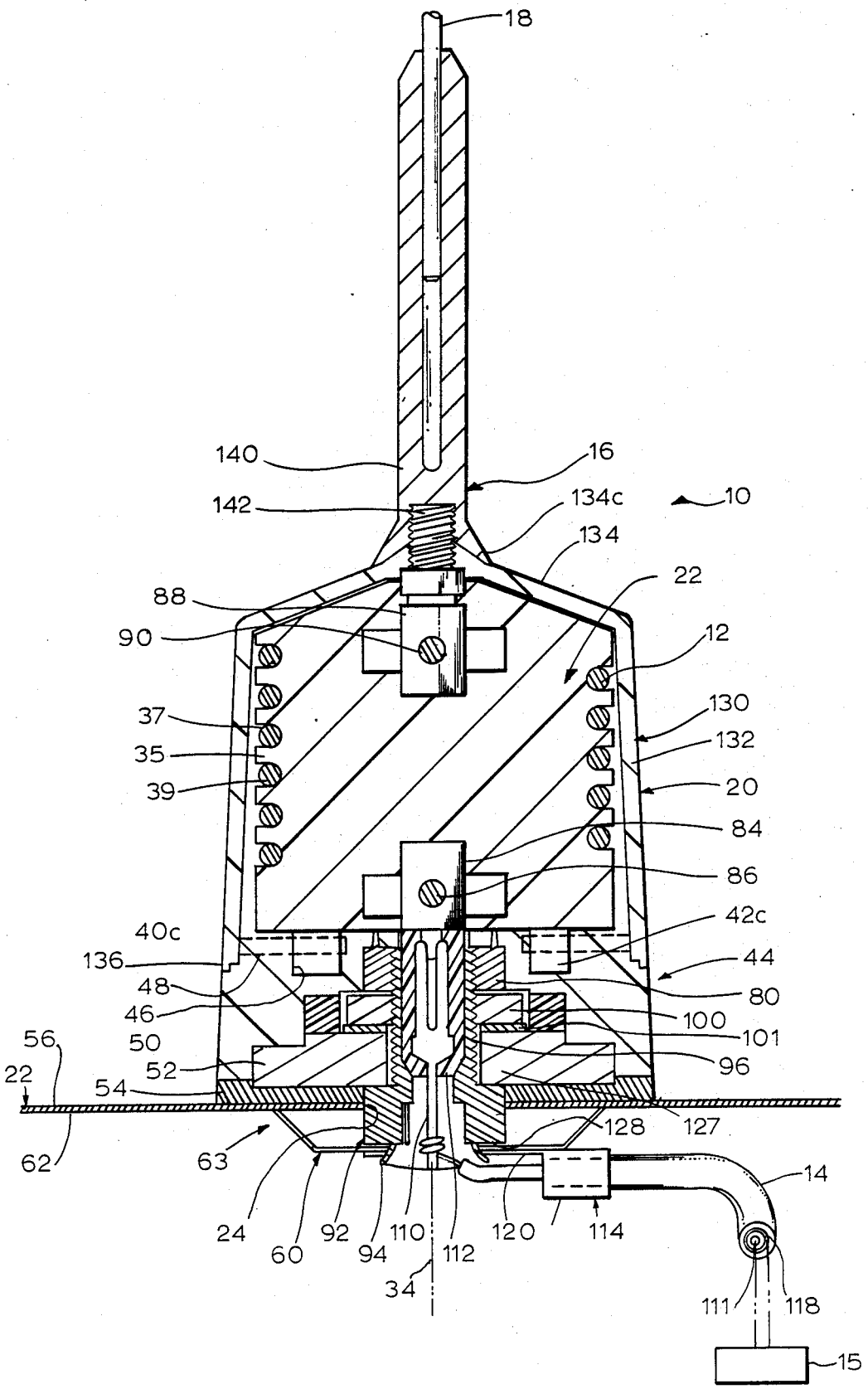
FIG. 4 is a sectional view taken on the line 4—4 of FIG. 3.
Figure 5:
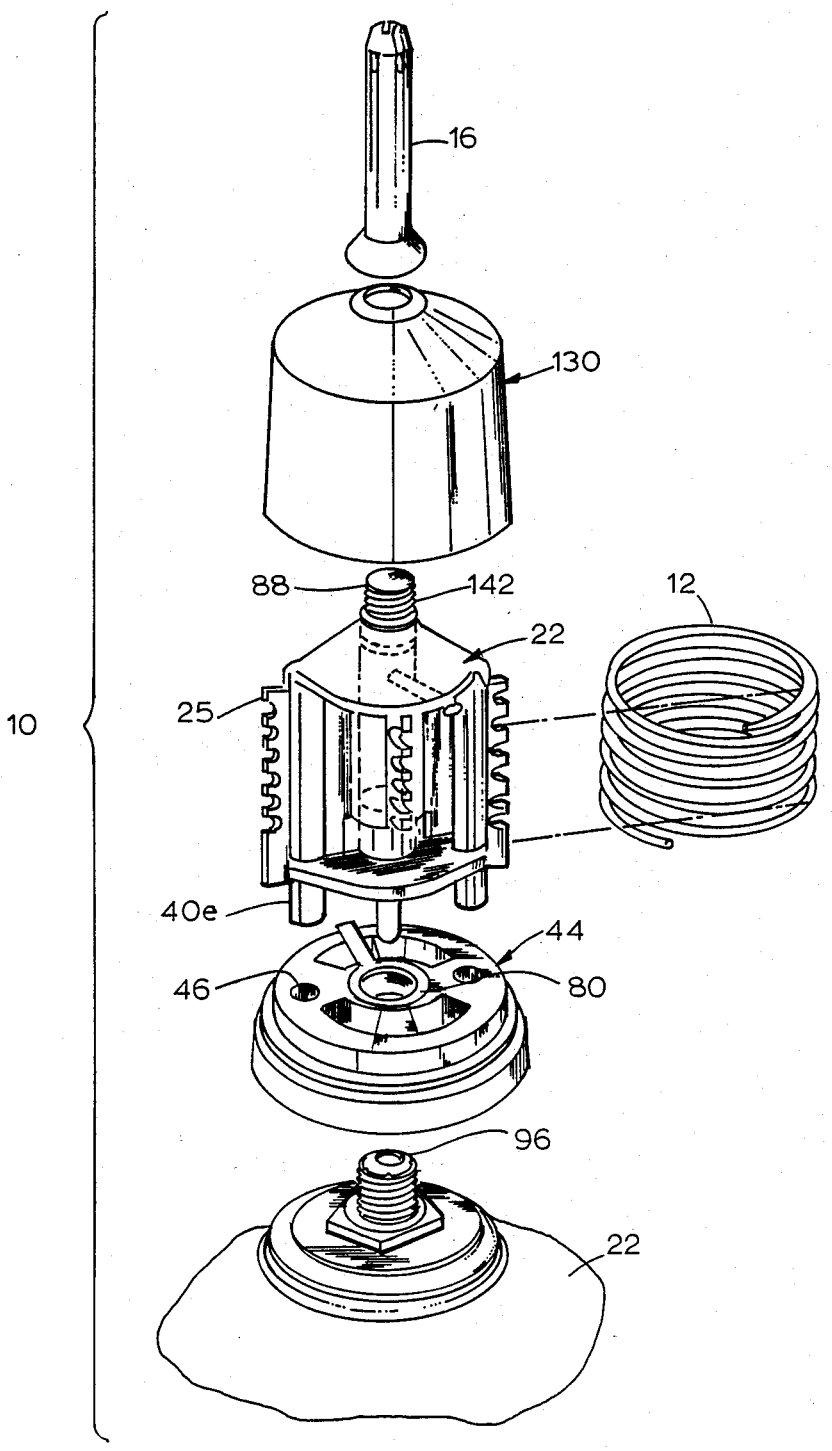
FIG. 5 is an exploded view of the antenna of FIG. 4.

FIG. 4 illustrates an antenna 10 of the present invention, which includes an electrically conductive coil 12. The coil has a lower end electrically connected to a coaxial conductor 14 that extends to a transducer 15, and an upper end electrically connected to an antenna mast assembly 16 which includes an upstanding antenna whip 18. The coil and other parts are securely held together by a frame 20 which can mount on a sheet metal body 22 of a vehicle around a hole 24 in the vehicle body. The antenna is generally mounted on the roof or trunk of an automobile, truck, or the like.

It is important to hold the coil 12 steady with respect to the other components of the antenna, to avoid vibrations that could cause fatigue failure, and to assure predictable characteristics for the antenna. The frame includes a coil support 22 of dielectric material such as molded plastic (e.g., polycarbonate resin) which engages each of the several turns of the coil to hold them securely in position. The coil support is constructed to minimize the capacitance between adjacent turns of the coil. While air has a dielectric constant of about 1.0, typical plastics have dielectric constants of about 2.2 to 2.7, so that the presence of such plastic material between adjacent coil turns results in considerably higher inter-turn capacitance.

The capacitance between turns of the coil is minimized by forming the coil support 22 as shown in FIGS. 7 and 8, so it includes several (at least two) narrow fins 24–27 with fin portions 28 of narrow width W that lie between adjacent coil turns. Each fin has several grooves 30 that closely receive the coil turns to stably hold the coil in position. Each fin extends by a small angle A, such as 5°, about the coil axis 34, and the four fins together therefore subtend an angle of only about 20°, which is much less than one half the 360° circumferential length of each turn. Thus, much more than half of the 360° circular length of the space 35 (FIG. 4) between each pair of adjacent coil turns 37, 39 is free of dielectric material, to thereby minimize the inter-turn capacitance.

The amount of dielectric material within the coil is also small, with much less than one half the volume within the coil occupied by the dielectric material of the coil support, as seen in FIG. 8. The high frequency alternating currents passing through the coil produce a corresponding high frequency magnetic field with the magnetic lines being most dense within the coil. Minimizing the amount of material within the coil minimizes the amount of heating of such material, and also leaves open spaces through which air can circulate to cool the material within the coil, especially the outer ends of the fins, and the coil itself. By minimizing heating of the coil support 22, applicant minimizes heating problems resulting from operating the antenna at high power levels.

The coil support includes a central column 36 which forms a core from which the fins 24–27 radiate out to beyond the inner diameter of the coil, and actually to its outer diameter. The column 36 and two posts 40, 42 provide rigidity. A conical top 41 and flat bottom deck 43 further rigidize the coil support. As shown in FIG. 4, the coil support rests on a molded dielectric mounting base 44 of the frame 20, with the lower ends 40*e*, 42*e* of the posts received in corresponding recesses 46 of the base. Anchor pins 48 extending through holes in the base and lower post ends securely hold them together, to prevent the coil support from moving up when under tension, as discussed below.

The base has a lower recess which holds a sealing ring 50 that rests on a standoff 52. The base and standoff rest on a rubber sealing gasket 54 that rests on the upper surface 56 of the vehicle sheet metal body. A star clamp plate 60 presses against the lower surface 62 of the sheet metal vehicle body, to thereby clamp the antenna in place on the vehicle. The parts below the base form a mount assembly 63 for mounting the frame, including the coil support 22 on a vehicle. Another type of mount assembly can be used to mount the frame on supports other than a vehicle.

Figure 6:
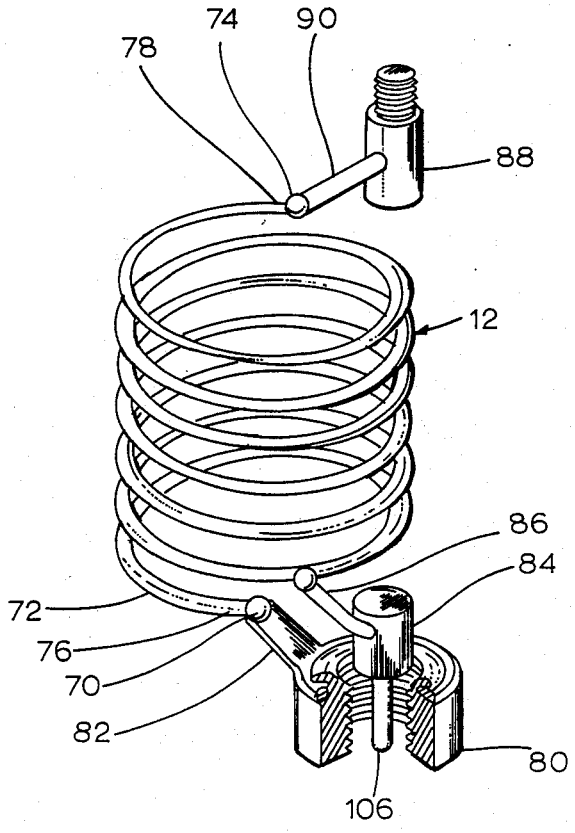
FIG. 6 is a schematic perspective view of the coil and its electrical terminal connections of the antenna of FIG. 4, with the connections shown as outside the coil instead of within it.

As shown in FIG. 6, electrical connections are made to the coil 12 at three locations 70, 72, 74. One end 76 of the coil may be considered to be the lower end since it usually (though not always) is lowermost, and the opposite end 78 may be considered the upper end. The entire input signal to the antenna is connected across the coil locations 70, 72 that are spaced slightly more than one turn apart, with the entire about six-turn coil forming an auto transformer. An electrically conductive ring element 80, which is molded into the base, is connected through a tab lead 82 and solder to the bottom coil location 70. A center pin 84 is connected through a conductor 86 and solder to the coil location 72. An upper pin 88 is connected through a conductor 90 and solder to the upper coil location 74. As indicated in FIG. 4, the pins 84, 88 are molded in place in the coil support 22.

An electrically conductive body mount 92 of the mount assembly 63 holds the antenna to the vehicle sheet metal body 22. A lower portion 94 of the body mount is attached to the star plate 60, the body mount projecting upwardly through the hole 24 in the vehicle sheet metal, and having a threaded upper portion 96. A nut 100 is threaded onto the upper portion 96 of the body mount, to push down against a lock washer 101; the lock washer holds down the standoff 52, which holds down the gasket 54 that presses against the vehicle body sheet metal. After the nut 100 has been tightened, the ring element 80 (and the base 44 and coil support 22 with coil thereon) is screwed onto the upper portion 96 of the body mount. During such screwing in, a center coaxial conductor 106 (FIG. 6) of the center pin 84 engages the upper portion of an inner conductor 110 (FIG. 4). The top of the inner conductor 110 is held in the body mount 96 by an insulative bridge support 112, and the lower end of conductor 110 is connected to the central conductor 111 of the coaxial cable 14. A coaxial cable holder 114 has a sleeve portion 116 that connects to the outer conductor 118 of the coaxial conductor 14, and has a flat portion 120 captured on the flat middle portion of the star plate 60. The lower portion 94 of the body mount is rolled over to hold itself and the cable holder portion 120 to the star plate.

The star plate 60 (FIG. 9) has a flat center portion 122 on which a flat portion 120 of the coaxial cable connector 114 is mounted. Thus, the flat portion 122 of the star plate serves to hold the bottom 94 of the body mount and a portion 120 of the coaxial cable holder, which both must be electrically grounded. The star plate has several pointed outer portions 126 which are bent up to be angled upwardly (at about 45°), so as the star plate is tightened against the vehicle sheet metal 22 the pointed star plate portions "dig" into the underside 62 of the vehicle sheet metal to provide a good electrical grounding connection thereto. The outer star plate portions 126 can bend to accommodate moderate variations in sheet metal thickness as between 20 and 90 thousandths inch. The thickness of the sheet metal 22 plus the middle of gasket 54 plus the bent star (minus thickness of star plate metal) must equal the distance between body mount shoulders 127, 128. This arrangement results in a predetermined amount of star plate deflection (which is limited to avoid breaking it) when mounted on a vehicle with sheet metal of given thickness.

The frame 20 (FIG. 4) includes a cover 130 with a tubular part 132 that surrounds the coil and coil support, and a roof 134 that lies over them. The tubular part of the cover has a lower portion 136 that fits into corresponding grooves formed in the top of the base 44. The roof 134 of the cover has a center portion 134c that lies between an antenna mast 140 of the mast assembly 16 and the pin 88 that is molded into the top of the coil support 22. The antenna mast 140 is installed by screwing its internally threaded lower end onto a threaded stud 142 formed at the top of the pin 88. As the antenna mast is screwed down, it presses against the central roof portion 134c of the cover, and thereby pulls up on the pin 88. Such upward pulling on the pin 88 results in holding the coil support 12 under tension loading, which is equal and opposite to the compression loading of the cover 130. Such tension loading of the coil support 22 and compression loading of the cover 130 helps to rigidize them against sideward bending. Large sideward bending forces are applied when the resilient antenna whip 18 is deflected far to one side, as when the vehicle passes into a tunnel or other obstruction of low height.

Applicant has constructed and tested an antenna of the type illustrated in FIGS. 1–9. The coil 12 is formed of about 34 inches of No. 10 copper wire (about 0.10 inch diameter) having a coil diameter of about 1.86 inches (as measured across the centers of the wire), and has about 5⅞ths turns. The spacing between turns (about 0.05 inch) is about half the wire thickness, and the ratio of length (height) to diameter of the coil is approximately 0.55. Each turn of the coil (and the space between adjacent turns) has a circumferential length of 5.84 inches, and only about one-third inch of that length of space between adjacent 360° turns is occupied by the dielectric material of the coil support. As described above, most of the space between turns of the coil is occupied by air rather than solid material, and most of the volume within the coil is occupied by air rather than solid material.

The Q factor, which denotes the overall efficiency of the antenna is given by the equation $Q=X/r$, where $X$=reactance and $r$ = series resistance. Distributed capacitance lowers the reactance X; minimizing interturn capacitance results in an increased X and therefore an increased Q. The resistance r was lowered by coating the wire with heavy silver plating, which is especially useful because most current at high frequencies travel in the surface region of a conductor. Similarly, the conductors 82, 86, and 90 (FIG. 6) which connect to the coil were heavily silver plated. Solder connections were made by silver solder.

FIGS. 10 and 11 illustrate another antenna 150 somewhat similar to that of FIGS. 1–9, but wherein a coil support 152 is formed in the cover 154 of the frame. The coil support includes a plurality of fins 156–159 radiating inwardly from a tubular part 153 of the cover 154, and having grooves 160 that closely surround the coil windings. This arrangement also results in most of the space between adjacent turns of the coil being unoccupied by solid (or liquid) material. Also, as in the case of the embodiment shown in FIG. 8, more than 75% of the area within the coil is unoccupied by solid material.

Thus, the invention provides a base loaded antenna which minimizes inter-turn capacitance along the coil while also minimizing heating of the base loading structure of the antenna when used at high power levels, and while also providing high rigidity and effective mounting to a vehicle. A dielectric coil support includes a plurality of fins that each engage wire turns, with the fins extending short enough distances along the circumference of the wire turns to leave most of the circumferential length of the coil unsupported by the fins. The coil support can lie within the coil and be anchored in place to withstand tension loading. A cover surrounds the coil and coil support and a threaded support at the top of the cover and coil support applies tension to the coil support and corresponding compression to the cover to provide greater resistance to deflection when the antenna whip is greatly deflected. The coil support is mounted on a base which is held to the sheet metal of a vehicle frame by a star plate lying on the underside of the vehicle sheet metal body. The star plate has bent-up pointed outer portions or edges that "dig" into the vehicle sheet metal to provide a ground electrical connection thereto. The middle of the star plate is flat to support a coaxial cable holder and the bottom of a body mount, and make electrical connection therewith.

Although particular embodiments of the invention have been described and illustrated herein, it is recognized that modifications and variations may readily occur to those skilled in the art and consequently it is intended to cover such modifications and equivalents.

What is claimed is:

1. In a base loaded antenna which includes a coil having a plurality of turns of electrically conductive wire and having upper and lower coil ends, conductors connected to said upper and lower coil ends, and a dielectric frame which includes a coil support, the improvement wherein:

said coil support includes a plurality of fins each engaging said wire turns and holding them at predetermined spacings from one another, said fins extending a short enough distance along the circumference of said wire turns to leave most of the circumferential length of the coil unsupported by said fins;

said frame includes a base connected to said coil support, said base having an electrically conductive ring element connected to the lower end of said coil; and including a star plate for lying on the underside of a vehicle sheet metal body, said star plate having a flat center portion and having a plurality of bent-up pointed outer portions for engaging the sheet metal body;

an electrically conductive body mount which includes upper and lower portions connected respectively to said base and said star plate, and a nut threadably coupled to said upper body mount portion so said nut can be tightened to press said outer portions of said star plate against the vehicle sheet metal body, said body mount upper portion being electrically connected to saiad ring element of said base;

an electrically conductive coaxial cable holder having a flat portion mounted on said flat center portion of said star plate and a cable engaging portion for mechanically holding a coaxial cable and electrically coupling to the outer conductor of the coaxial cable, whereby the star plate provides mechanical holding and an electrical ground connection.

2. The improvement described in claim 1 wherein:

said bent-up pointed outer portions extend at an angle from the vertical and said star plate is formed of sheet metal that is thin enough, that said bent-up portions can bend to accommodate vehicle sheet metal of a range of thicknesses between about 20 and 90 thousandths inch.

3. A base loaded antenna comprising:

a coil having an axis and a plurality of turns of electrically conductive wire, said coil having upper and lower end portions;

a frame which includes a base with electrical conductors coupled to said lower coil end portion for carrying electrical signals thereto;

an antenna mast assembly mounted on said frame and coupled to said upper coil portion for radiating said signals;

said frame including a coil support comprising an integral molded member that includes a core mounted on said base and lying within said coil, and a plurality of fins radiating from said core and forming grooves that closely receive said wire turns, said fins having portions lying between said grooves between adjacent wire turns and supporting less than 90° of each coil turn;

a plurality of said fins of said coil support each including an enlargement in width forming a post extending along the length of said coil support, said posts each having a lower end anchored to said base.

4. The antenna described in claim 3 including:

a cover which surrounds said coil and which has a lower end lying on said base and an upper end;

a pin extending laterally through each of said post lower ends and coupled to said base to prevent separation of said coil support and base;

said coil support having an upper end, and said antenna mast assembly including a threaded part threadably coupled to the upper end of said coil support and coupled to the upper end of said cover, and arranged so threadable tightening of said threaded coupling part pulls said coil support in a direction away from said base and pushes said cover toward said base, whereby to maintain the coil support in tension by forces applied through said posts.

5. In a base loaded antenna which includes a coil having a plurality of turns of electrically conductive wire and having upper and lower coil ends, conductors connected to said upper and lower coil ends, and a dielectric frame which includes a coil support and a cover lying about the coil support and coil, the improvement wherein:

said coil support has upper and lower ends and includes a core and a plurality of fins radiating from said core, each fin engaging said wire turns and holding them at predetermined spacings from one another, said fins extending a short enough distance along the circumference of said wire turns to leave most of the circumferential length of the coil unsupported by said fins;

said frame includes a base coupled to said lower ends of said coil support and cover; and including means coupled to said upper ends of said coil support and said cover, for pulling up said upper end of said coil support to load said coil support in tension, and for pressing down on said upper end of said cover to load it in compression.

* * * * *